United States Patent [19]

Raymond

[11] Patent Number: 4,630,576

[45] Date of Patent: Dec. 23, 1986

[54] INTAKE VALVE ROCKER ARMS OF CERTAIN SIX CYLINDER INTERNAL COMBUSTION ENGINES

[76] Inventor: Kenneth W. Raymond, 956 E. Seminole Dr., Venice, Fla. 33595

[21] Appl. No.: 734,042

[22] Filed: May 15, 1985

[51] Int. Cl.[4] ..... F01M 9/10

[52] U.S. Cl. ..... 123/90.36; 123/90.37; 123/90.39

[58] Field of Search ..... 123/90.36, 90.37, 90.39, 123/90.33, 90.46

[56] References Cited

U.S. PATENT DOCUMENTS

| | | | |
|---|---|---|---|
| 1,469,480 | 10/1923 | Manville | 123/90.36 |
| 1,842,555 | 1/1932 | McLeod | 123/90.36 |
| 2,288,831 | 7/1942 | O'Harrow | 123/90.36 |
| 2,522,326 | 9/1950 | Winter | 123/90.36 |
| 2,525,791 | 10/1950 | Good | 123/90.36 |
| 2,563,699 | 8/1951 | Winter | 123/90.36 |
| 2,650,579 | 9/1953 | Bernight | 123/90.36 |
| 3,048,156 | 8/1962 | Van Slooten | 123/90.36 |
| 3,146,767 | 9/1964 | Dadd | 123/90.36 |

*Primary Examiner*—Ira S. Lazarus

*Attorney, Agent, or Firm*—Hauke and Patalidis

[57] ABSTRACT

In certain motor vehicles having six cylinder internal combustion engines, the excessive use of lubricating oil after the vehicle has been driven 50,000 miles is stopped by inserting a drive rivet into the radial oil passageway in the intake valve rocker arms; such passageway connecting with an internal lubricating oil groove in the rocker arm.

3 Claims, 3 Drawing Figures

INTAKE VALVE ROCKER ARMS OF CERTAIN SIX CYLINDER INTERNAL COMBUSTION ENGINES

BACKGROUND OF THE INVENTION

The present invention relates to motor vehicle internal combustion engines and more particularly, to an improvement in rocker arms that actuate the intake valves of certain six-cylinder engines.

The internal combustion engines of certain motor vehicles have been known to consume excessive quantities of lubricating oil after the vehicle has been driven 50,000 miles. Such excessive lubricating oil consumption has been traced to abnormal wear of the oil seals on the stems of the intake valves of such six-cylinder engines.

The wear of such oil seals allows lubricating oil to flood from the intake valve rocker arms over the valve spring seats and the valve springs, and to be sucked into the intake manifold. This condition results in oil fouled spark plugs, and carbon build-up on the pistons and the combustion chamber.

The usual remedy for such a situation is to replace the intake valve seals. But, new valve seals are not the solution to the problem. In a matter of a few thousand more driving miles, the newly installed valve seals become worn, they leak, and another valve-seal replacement program is required.

The case of the problem is excessive lubricating oil being forced from a radial hole in intake valve rocker arm mentioned hereinbefore.

The problem of excessive lubricating oil on the intake valves has been solved by my invention. In one instance, as an example, after installing new valve seals on the intake valves of one of the aforementioned six-cylinder engines, I installed my invention on the intake valve rocker arms of such engine. I then operated the motor vehicle for 2,000 and only one quart of lubricating oil was needed to replace the oil consumed.

In another instance, I installed by improvement on the intake valve rocker arms of another six-cylinder engine that was using one quart of lubricating oil every 200 miles. Thereafter I found that only one quart of oil was needed after operating the motor vehicle for 3,500 miles.

It is clear that there is no need to replace intake valve seals on these six-cylinder engines. All that is required is to install my invention in the rocker arms.

SUMMARY OF THE INVENTION

In certain motor vehicle internal combustion engines particularly those having six cylinders, with intake rocker arms that have a radial passageway in the boss thereof, the improvement in such rocker arms comprises inserting a drive rivet into the radial passageway to prevent lubricating oil from flowing therefrom over the top of the intake valve spring and upper valve assembly, and being sucked into the intake manifold of such engines.

For a further understanding of the invention and for features and advantages thereof, reference may be made to the following description of the invention and to the drawing.

DETAILED DESCRIPTION OF THE PREFERRED EMBODIMENT

Figure 1:
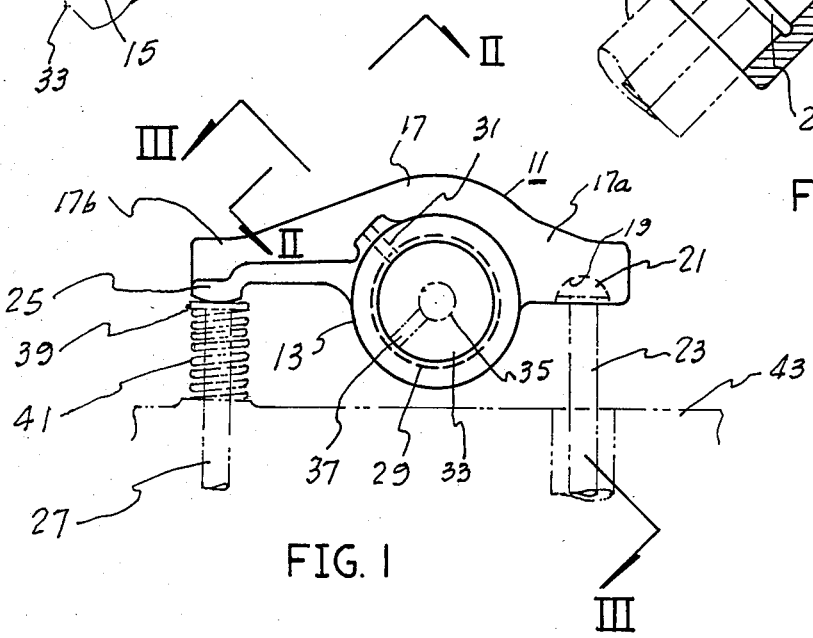
FIG. 1 is a schematic elevational view of a typical six cylinder internal combustion engine showing a typical intake valve rocker arm with valve spring assembly and push rod.

Referring to FIG. 1, a conventional rocker arm 11 that actuates an intake valve of a six cylinder engine comprises a main body portion 13 having cylindrical boss 15 surmounted by a ridge 17 extending outwardly left and right, as viewed in FIG. 1. The ridge 17 in the right hand side **17*a* has an internal cup 19 which receives the ball end 21 of a push rod 23 that is actuated by a cam (not shown) on the cam shaft within the engine. The ridge 17 on the left hand side 17*b* merges with a foot 25 that is wider than the ridge 17 and is slightly rounded and coacts with top end of the intake valve stem 27**.

The boss 15 has an internal groove 29 in the inner surface thereof and a hole 31 is drilled through the boss 15 so as to communicate with the internal groove 29.

The rocker arm 11 is shown in position on a rocker arm shaft 33 which has an internal elongate central passage 35 and a radial internal passage 37 that fluidly connects the central passage 35 with the internal groove 29 in the boss 15.

The foot 25 is shown acting on the top end of the intake valve stem which is provided with the conventional retainer 39 and valve spring 41. The rocker arm 11, the intake valve stem 27, pushrod 23 are shown schematically on an engine block 43.

Figure 2:
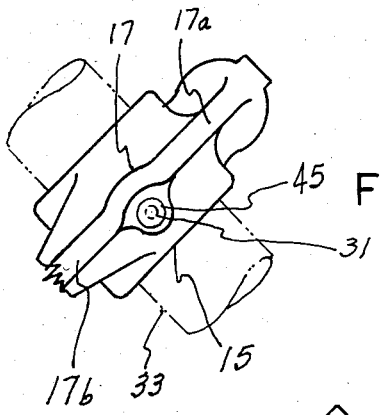
FIG. 2 is a view along line II—II of FIG. 1.
Figure 3:
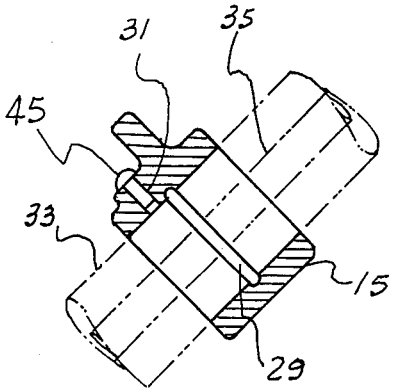
FIG. 3 is a sectional view along line III—III of FIG. 1.

FIG. 3 illustrates my improvement in the conventional intake valves rocker arm of certain six-cylinder automobile internal combustion engines. My improvement comprises a drive rivet 45 inserted into the hole 31 whereby lubricating oil cannot escape through the hole 31 and cause excessive oil consumption, fouling of spark plugs, and carbonizing of the cylinder heads.

I have found that the drive rivet may be cemented in place in the radial passageway by using any suitable conventional cement.

I have found that there is sufficient lubricating oil to lubricate the rocker arm where it coacts with the valve stem and the oil that now flows through the open hole 31 is not wasted.

A further advantage and a feature of my invention is that there is no abnormal wear of valve seals on the intake valves and oil constumption is reduced to one quart of oil for 2,000 operating miles of service. In some instances, where my invention has been used in such six-cylinder engines having rocker arms with holes in the boss like hole 31, oil consumption has been reduced to one quart of oil for 3,500 driving miles. The same engine used one quart after 300 driven miles before my invention was used on the engine.

While the foregoing describes one embodiment of my invention, it is understood that modifications may be made thereto without departing from the scope of the invention as set forth in the following claims.

What is claimed is:

1. in an internal combustion engine wherein rocker arms coact with the top of the valve stems of intake valves therein and wherein each one of said rocker arms has an internal peripheral groove that conveys lubricating oil through a radially extending passage in said rocker arm so that lubricating oil flows into the top of the intake valve stems, the improvements in said rocker arm comprising means for sealing said radial passage in said rocker arm in such a way that lubricating oil does not flow through said radial passage onto said intake valve stem.

2. The rocker arm of claim 1 wherein said means for sealing said radial passages includes a drive rivet inserted into each said radial passage thereby preventing lubricating oil flow from said radial passages.

3. The rocker arm of claim 2 wherein said drive rivet is cemented in place in said radial passage.

* * * * *